US005520139A

United States Patent [19]

King et al.

[11] Patent Number: 5,520,139

[45] Date of Patent: May 28, 1996

[54] BOAT CANOPY

[76] Inventors: Paul F. King, 6827 Thames Rd., Woodbury, Minn. 55125; David A. Huebner, 724-9th Ave. S., So. St. Paul, Minn. 55075

[21] Appl. No.: 372,921

[22] Filed: Jan. 17, 1995

[51] Int. Cl.[6] ..... B63B 17/00

[52] U.S. Cl. ..... 114/361; 114/364

[58] Field of Search ..... 114/361, 364; 248/538, 231.6; 296/107, 108, 109, 111, 112

[56] References Cited

U.S. PATENT DOCUMENTS

| | | | |
|---|---|---|---|
| 2,829,660 | 4/1958 | Wester et al. | 114/361 |
| 3,307,566 | 3/1967 | Hale | 114/361 |
| 4,951,594 | 8/1990 | Feikema | 114/361 |
| 5,163,652 | 11/1992 | King | 248/538 |
| 5,303,667 | 4/1994 | Zirkelbach | 114/361 |

FOREIGN PATENT DOCUMENTS

| | | | |
|---|---|---|---|
| 1242613 | 10/1988 | Canada | 114/361 |

*Primary Examiner*—Sherman Basinger
*Attorney, Agent, or Firm*—Thomas B. Tate

[57] ABSTRACT

A boat canopy which can be removeably mounted onto the gunwales of a boat, and which can be adjusted forward and backward into various positions. The canopy comprises a canvas top and a plurality of bows which are assembled as one piece, a plurality of leg supports, a plurality of clamps which clamp onto the gunwales, and a plurality of quick-disconnect pins which allow for easy assembly and disassembly.

2 Claims, 2 Drawing Sheets

BOAT CANOPY

SUMMARY AND BACKGROUND OF THE INVENTION

Several types of canvas boat canopies have been used on fishing boats to provide the fishermen with shade. Typically these prior art devices come disassembled and the consumer must do the assembly. Usually it is necessary to drill holes into the gunwale of the boat in order to attach the canopy. In addition, prior art canopies often use nylon straps as supporting devices, which interfere with and reduce the area of the boat which can be used for fishing.

The present invention has a solid bow instead of the split bow found in prior art devices and comes partially assembled. The canopy removeably attached to the gunwales by means of clamps which are an improved version of the clamp described by King (one of the co-inventors of the present invention) in U.S. Pat. No. 5,163,652. The canopy can be easily assembled by means of a plurality of quick-disconnect pins.

The present invention has the advantage of being easy to install without the use of tools. It can also be moved easily into various positions and therefore does not interfere with fishing.

Another advantage is that all of the tubing is the same size, and thus the canopy fits together tighter and is less likely to come apart than prior art devices which use different sizes of tubing.

DESCRIPTION OF THE INVENTION

Figure 1:
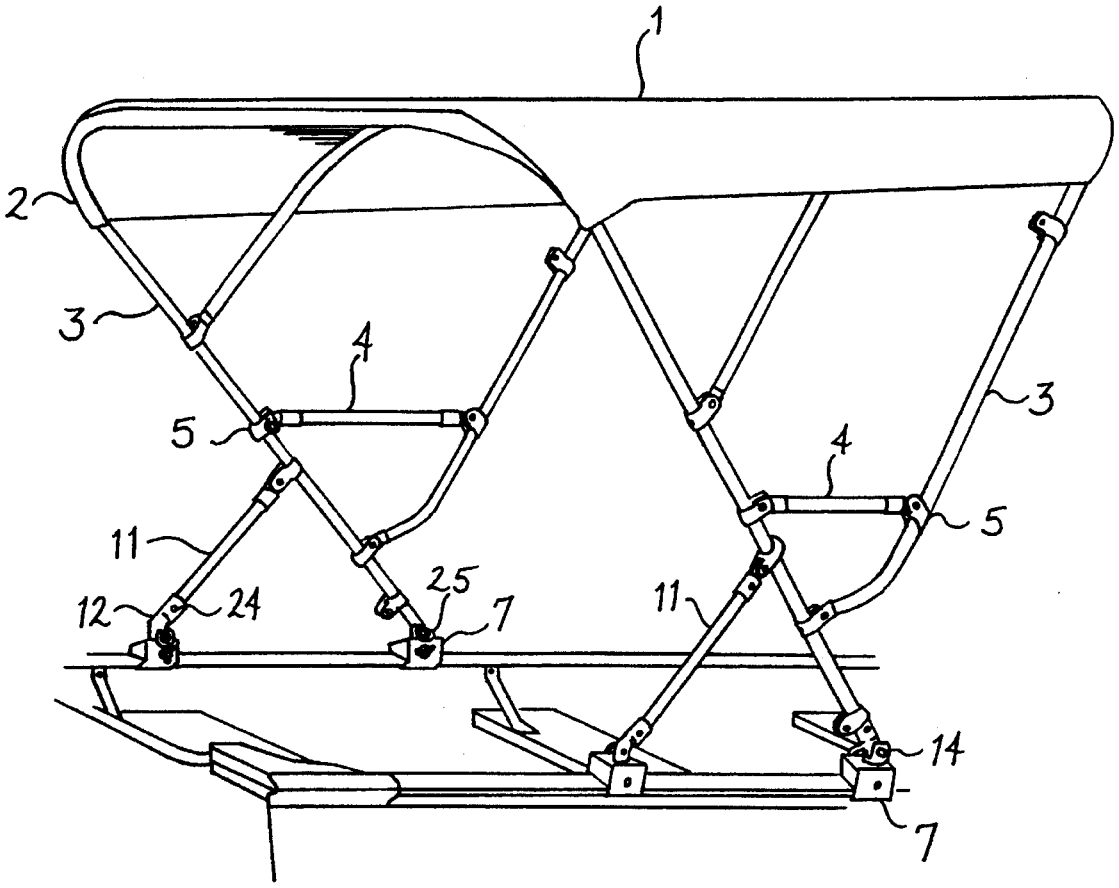
FIG. 1 is a side view showing the canopy in the upright position on the gunwale of a boat.
Figure 2:
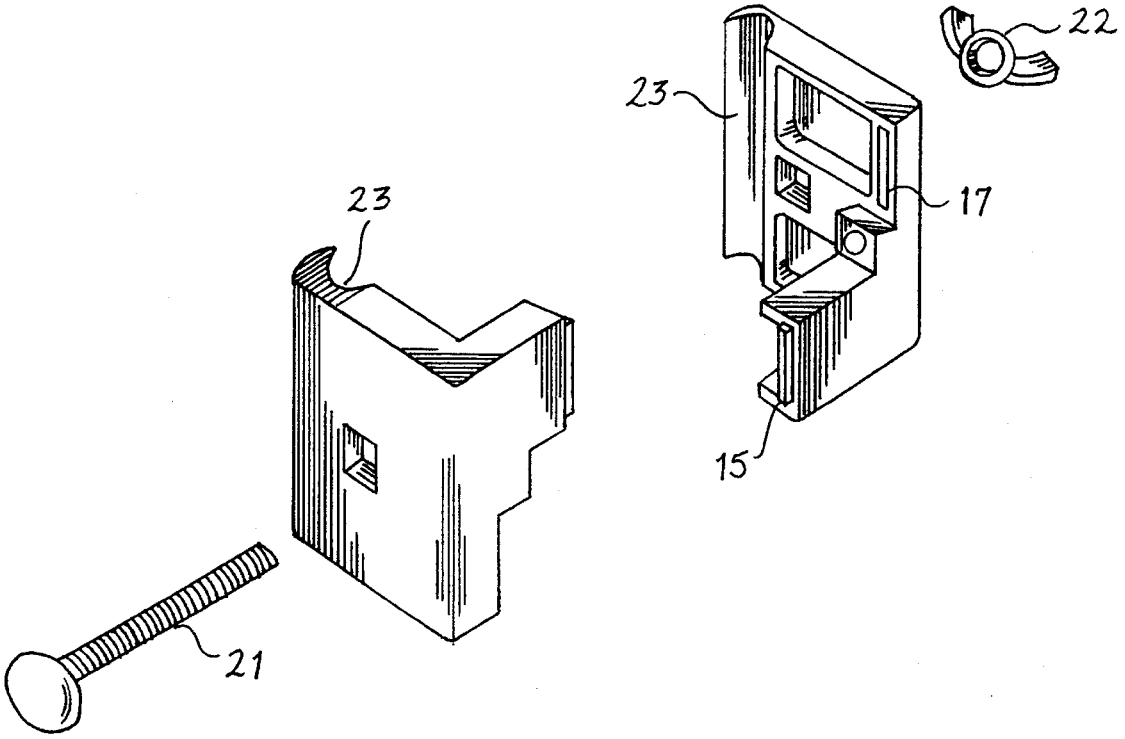
FIG. 2 is an exploded view of the components of the gunwale grabber clamps. In this view, the disassembled clamp is shown lying on end.

The invention is a boat canopy which can be removeably mounted onto the gunwales of a boat, and which can be adjusted forward and backward into various positions.

The canopy comprises a canvas top and a pluarlity of bows which are assembled as one piece, a plurality of leg supports, a plurality of clamps which clamp onto the gunwales, and a plurality of quick-disconnect pins which allow for easy assembly and disassembly.

The canvas top 1 and the three solid (not sections) bows 2 are assembled as one piece. Legs 3, comprising tubing (preferably made of stainless steel) which is the same diameter as the bows 2, telescope into the bows 2 and are snapped into position by a spring clamp inside each of the legs 3, which is activated when holes located about two inches from the end of leg 3 match up with the hole in corresponding bow 2.

A cross-member 4 is connected to the diagonal tubing legs 3 on either side of the canopy, and is attached to legs 3 by a jaw slide 5 at either end.

Two pair of gunwale grabber clamps 7 are attached to the gunwales of the boat. The first pair has one clamp each on the port and starboard gunwales at or slightly behind the midpoint of the gunwales. The second pair has one clamp each on the port and starboard gunwales further towards the stern than the first pair. Each of these clamps 7 comprises two generally L-shaped pieces which snap together such that a projection 15 on each piece fits into a slot 17 on its corresponding piece, the pieces further being held together by a bolt 21 disposed through openings in both pieces and held on by a wing nut 22. Each piece of clamp 7 has an arcuate groove 23 formed into its lower portion to grip onto the gunwale securely. On each side of the canopy, one of the tubing legs 3 fits into the front clamp 7 by means of a jaw slide assembly (the jaw slide 5 has a slotted eye end 12 and a set screw 24 on the opposite end). The leg support comes in at an angle. A U-shaped support rests on top of clamp 7 and has a stem which fits into an opening in the top of clamp 7) and a rear support leg 11 fits into an opening at the top of the rear clamp 7 by means of an eye end 12 which fits over the leg 11 and is held on by a set screw 24. The rear leg 11 is connected to the leg 3 by means of a jaw slide 5.

On each side of the canopy, a quick-disconnect pin 14 fits into an opening in jaw slide 5 at the junction of cross-member 4 with leg 3, and a quick-disconnect pin 14 also fits through an opening in the eye end 12 connecting rear support leg 11 to rear clamp 7, and through an opening in the U-shaped support of jaw slide 5 connecting tubing leg 3 to front clamp 7. Each pin 14 is provided with a ring 25.

By pushing and pulling the pin 14, the canopy can be moved into various positions ranging from all the way up to all the way down and intermediate along the way. The front pair of clamps 7 serve as pivot points, and the back pair of clamps 7 can be slid forward along the gunwales to push the canopy back up. The front pair of clamps are moveable also. When the pins 14 by support leg 11 and cross-member 4 are pulled, the bow 2 can be put into the jaw slide 5 for storage, and the whole top can lie flat upon the clamps 7 while in storage. When the pins 14 by the cross-member 4 are pulled the top 1 can go back at a forty-five degree angle and can be trailered without resting on the gunwales.

We claim:

1. A boat canopy comprising:

a first pair of clamps mounted onto the gunwales of the boat, one of said clamps being mounted onto the port gunwale and the other of said clamps being mounted onto the starboard gunwale;

a second pair of clamps mounted onto said port and starboard gunwales, respectively, sternward of said first pair of clamps;

a first pair of tubing legs, each member of said pair being connected by a jaw slide and eye end assembly to the member of said first pair of clamps which is on the same side of the boat;

a second pair of tubing legs, each member of said pair being connected to the member of said first pair of tubing legs which is on the same side of the boat;

a third pair of tubing legs, each member of said pair being connected to the member of said first pair of tubing legs which is on the same side of the boat;

a pair of cross-members, each cross-member connecting the member of said first pair of tubing legs to the member of said second pair of tubing legs which is on the same side of the boat, said connections being made by means of a jaw slide at either end of each of said cross-members;

a pair of rear support legs, each member of said pair being connected by a jaw slide to the member of said first pair of tubing legs which is on the same side of the boat, and also being connected by an eye end to the member of said second pair of clamps which is on the same side of the boat;

a top having at least three bows assembled as a unit, said top and said bows fitting over said first, second, and third pair of tubing legs such that said tubing legs are telescoped into said bows;

a pin disposed through an opening in each of said jaw slides which connects said cross-members to said first pair of tubing legs, and through an opening in each of said eye ends connecting said rear support legs to said second pair of clamps, and through an opening in said jaw slide and eye end assemblies connecting said first pair of tubing legs to said first pair of clamps, said pins being adjustable so as to allow said canopy to be placed into various positions using said first pair of clamps as pivot points.

2. The invention of claim 1 wherein each of said clamps which comprises said first and second pair of clamps has a structure comprising two pieces which interlock by inserting a projection on each of said pieces into a slot on its corresponding piece.

* * * * *